United States Patent [19]

McCabe

[11] 4,434,762

[45] Mar. 6, 1984

[54] APPARATUS AND SYSTEM FOR CONTROLLING THE AIR-FUEL RATIO SUPPLIED TO A COMBUSTION ENGINE

[75] Inventor: Ralph P. McCabe, Troy, Mich.

[73] Assignee: Colt Industries Operating Corp., New York, N.Y.

[21] Appl. No.: 309,585

[22] Filed: Oct. 8, 1981

[51] Int. Cl.[3] ..... F02B 33/00; F02M 7/00

[52] U.S. Cl. ..... 123/438; 261/74; 261/82

[58] Field of Search ..... 123/438, 440; 261/74, 261/82

[56] References Cited

U.S. PATENT DOCUMENTS

| | | | |
|---|---|---|---|
| 4,165,719 | 8/1979 | Asano | 123/440 |
| 4,224,908 | 9/1980 | Bier | 123/440 |
| 4,318,869 | 3/1982 | Stoltman | 123/440 |
| 4,338,901 | 7/1982 | McCabe | 123/440 |

*Primary Examiner*—Ronald B. Cox

*Attorney, Agent, or Firm*—Walter Potoroka, Sr.

[57] ABSTRACT

A carbureting type fuel metering apparatus has a primary and secondary induction passage into which fuel is fed by several fuel metering systems among which are primary and secondary main fuel metering systems and an idle fuel metering system, as generally known in the art; engine exhaust gas analyzing means sensitive to selected constituents of such exhaust gas creates a feedback signal which through an associated solenoid transducer becomes effective for controllably modulating the metering characteristics of the main fuel metering system systems, and, if desired, the idle fuel metering system as to thereby achieve the then desired optimum metering function; the solenoid transducer is shown as simultaneously controlling two valving members and is effective upon experiencing a failure to assume a position providing for a lean fuel mode of engine operation.

10 Claims, 6 Drawing Figures

APPARATUS AND SYSTEM FOR CONTROLLING THE AIR-FUEL RATIO SUPPLIED TO A COMBUSTION ENGINE

BACKGROUND OF THE INVENTION

Even though the automotive industry has over the years, if for no other reason than seeking competetive advantages, continually exerted efforts to increase the fuel economy of automotive engines, the gains continually realized thereby have been deemed by various levels of governments to be insufficient. Further, such levels of government have also imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, the available technology employable in attempting to attain increases in engine fuel economy is, generally, contrary to that technology employable in attempting to meet the governmentally imposed standards on exhaust emissions.

For example, the prior art, in trying to meet the standards for $NO_x$ emissions, has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust, which, in turn, requires the supplying of additional oxygen, as by an associated air pump, to such engine exhaust in order to complete the oxidation of the CO and HC prior to its delivery into the atmosphere.

The prior art has also heretofore proposed retarding of the engine ignition timing as a further means for reducing the creation of $NO_x$. Also, lower engine compression ratios have been employed in order to lower the resulting combustion temperature within the engine combustion chamber and thereby reduce the creation of $NO_x$.

The prior art has also proposed the use of fuel metering injection means instead of the usually-employed carbureting apparatus and, under superatmospheric pressure, injecting the fuel into either the engine intake manifold or directly into the cylinders of a piston type internal combustion engine. Such fuel injection systems, besides being costly, have not proven to be generally successful in that the system is required to provide accurately metered fuel flow over a very wide range of metered fuel flows. Generally, those injection systems which are very accurate at one end of the required range of metered fuel flows, are relatively inaccurate at the opposite end of that same range of metered fuel flows. Also, those injection systems which are made to be accurate in the mid-portion of the required range of metered fuel flows are usually relatively inaccurate at both ends of that same range. The use of feedback means for altering the metering characteristics of a particular fuel injection system have not solved the problem because the problem usually is intertwined with such factors as: effective aperture area of the injector nozzle; comparative movement required by the associated nozzle pintle or valving member; inertia of the nozzle valving member and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits of, for example, 1.0 gram/mile of $NO_x$ (or even less).

The prior art, in view of such anticipated requirements with respect to $NO_x$, has suggested the employment of a "three-way" catalyst, in a single bed, within the stream of exhaust gases as a means of attaining such anticipated exhaust emission limits. Generally, a "three-way" catalyst (as opposed to the "two-way" catalyst system also well known in the prior art) is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively, but the oxidation of CO will be incomplete. On the other hand, if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinafter described, the prior art has suggested the use of fuel injection means with associated feedback means (responsive to selected indicia of engine operating conditions and parameters) intended to continuously alter or modify the metering characteristics of the fuel injection means. However, at least to the extent hereinbefore indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means cannot, at least as presently conceived, provide the degree of accuracy required in the metering of fuel to an associated engine as to assure meeting, for example the said anticipated exhaust emission standards.

Accordingly, the invention as disclosed, described and claimed is directed generally to the solution of the above and other related and attendant problems and more specifically to structure, apparatus and system enabling a carbureting type fuel metering device to meter fuel with an accuracy at least sufficient to meet the said anticipated standards regarding engine exhaust gas emissions.

SUMMARY OF THE INVENTION

According to one aspect of the invention, a carburetor having a primary and a secondary induction passage therethrough each with a venturi therein and each having a main discharge nozzle situated generally within the venturi and respective primary and secondary main fuel metering systems communicating generally between a fuel reservoir and the respective main fuel discharge nozzles, and having an idle fuel metering system communicating generally between a fuel reservoir and said primary induction passage at a location generally in close proximity to an edge of a variably openable throttle valve situated in said induction passage downstream of the main fuel discharge nozzle, is provided with solenoid valving means effective to controllably alter the rate of metered fuel flow through the main fuel metering systems and/or the idle fuel metering system as to thereby precisely control the rate of total metered fuel flow through such metering system to the associated engine, the solenoid valving means upon experiencing a failure being effective to operate in a mode whereby the associated engine is provided metered fuel which is comparatively lean, in terms of fuel, but forming a fuel-air ration sufficient to support combustion.

Various general and specific objects, advantages and aspects of the invention will become apparent when reference is made to the following detailed description of the invention considered in conjunction with the related accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
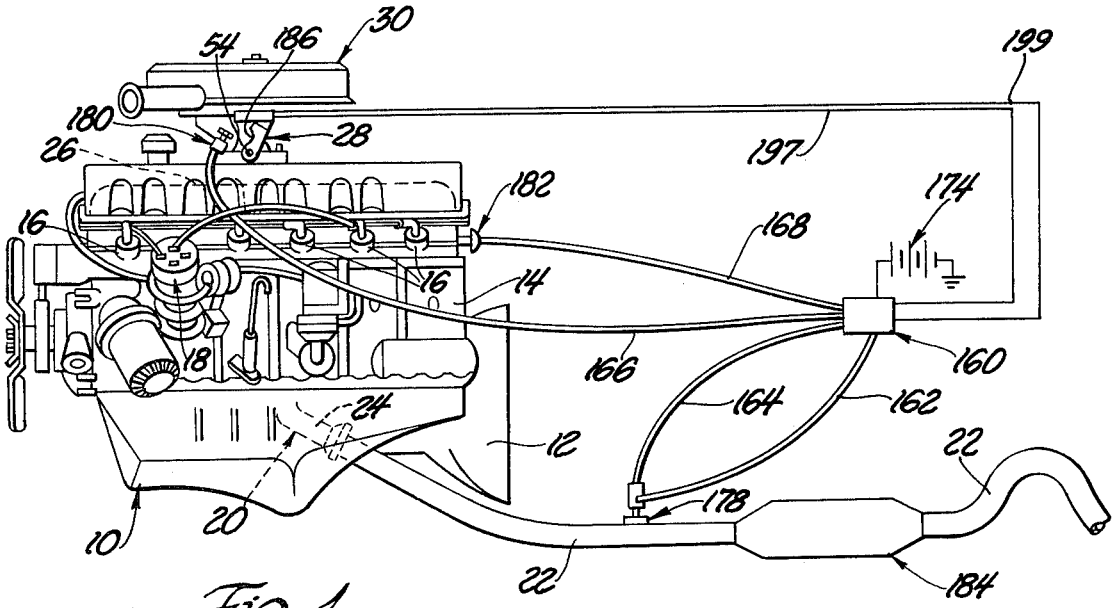
FIG. 1 illustrates, in side elevational view, a vehicular combustion engine employing a carbureting apparatus and system employing teachings of the invention.

Referring now in greater detail to the drawings, FIG. 1 illustrates a combustion engine 10 used, for example, to propel an associated vehicle as through power transmission means fragmentarily illustrated at 12 and ground-engaging drive wheel means (not shown). The engine 10 may, for example, be of the internal combustion type employing, as is generally well known in the art, a plurality of power piston means therein. As generally depicted, the engine assembly 10 is shown as being comprised of an engine block 14 containing, among other things, a plurality of cylinders respectively reciprocatingly receiving said power pistons therein. A plurality of spark or ignition plugs 16, as for example one for each cylinder, are carried by the engine block and respectively electrically connected to an ignition distributor assembly or system 18 operated in timed relationship to engine operation. As is generally well known in the art, each cylinder containing a power piston has exhaust aperture or port means and such exhaust port means communicate as with an associated exhaust manifold which is fragmentarily illustrated in hidden line at 20. Exhaust conduit means 22 is shown operatively connected to the discharge end 24 of exhaust manifold 20 and leading as to the rear of the associated vehicle for the discharging of exhaust gases to the atmosphere.

Further, as is also generally well known in the art, each cylinder which contains a power piston also has inlet aperture means or port means and such inlet aperture means communicate as with an associated inlet manifold which is fragmentarily illustrated in hidden line at 26.

As generally depicted, a carbureting type fuel metering apparatus 28 is situated atop a cooperating portion of the inlet or intake manifold means 26. A suitable inlet air cleaner assembly 30 may be situated atop the carburetor assembly 28 to filter the air prior to its entrance into the inlet of the carburetor 28.

Figure 2:
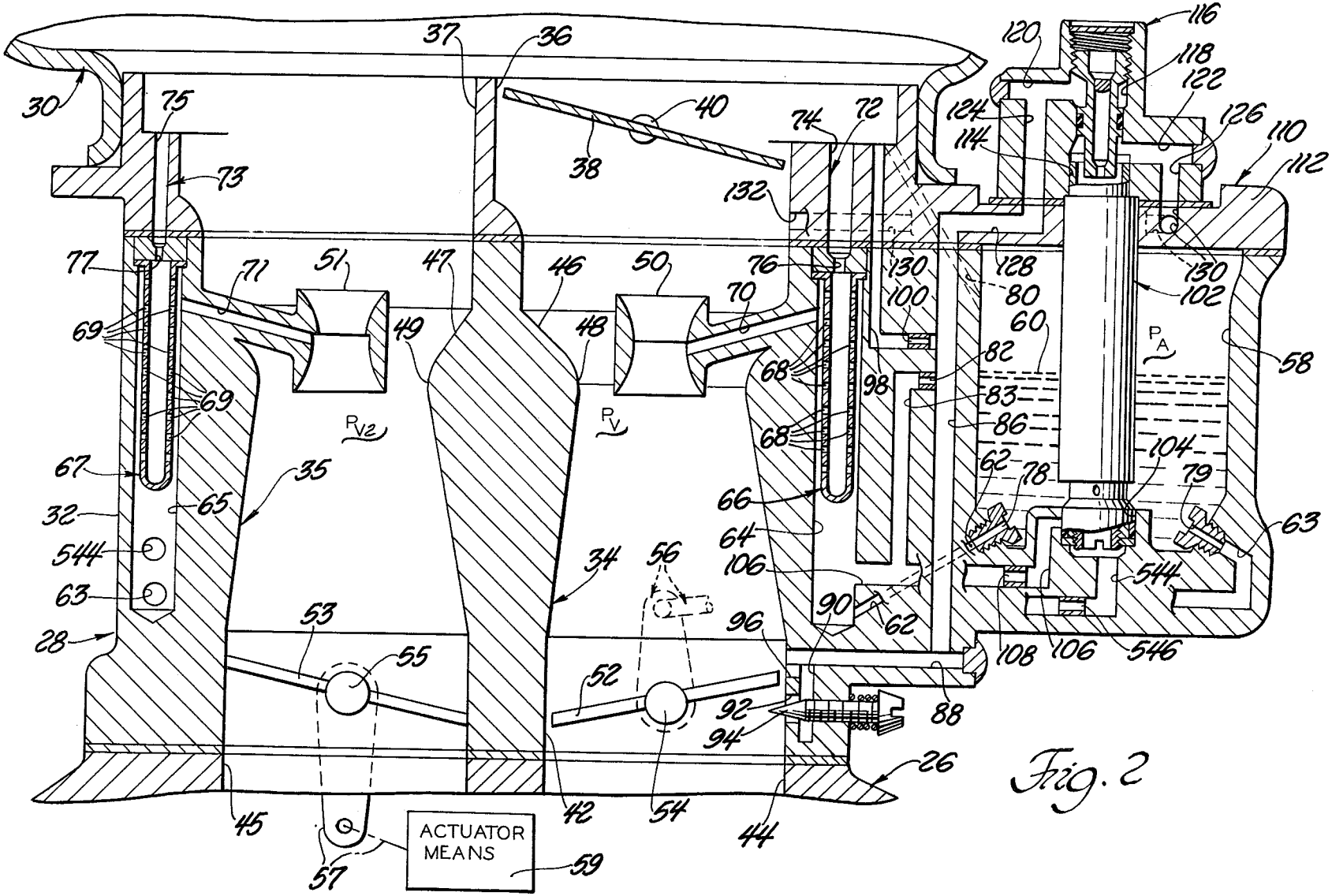
FIG. 2 is an enlarged cross-sectional view of a carbureting assembly employable as in the overall arrangement of FIG. 1.

FIG. 2 illustrates the carburetor 28, employing teachings of the invention, as comprising a main carburetor body 32 having primary induction passage means 34 as secondary induction passage means 35 formed therethrough with respective upper inlet ends 36 and 37. A variably openable choke valve 38 is carried as by a pivotal choke shaft 40 as to be situated generally in the inlet end 36 of induction passage means 34 while respective discharge ends 42 and 43 communicate as with respective inlets 44 and 45 of intake manifold 26. A venturi section 46, having a venturi throat 48, is provided within the induction passage means 34 generally between the inlet 36 and outlet or discharge end 42 while a venturi section 47, having a venturi throat 49, is provided within the induction passage 35 generally between the inlet 37 and outlet or discharge end 43. A primary main metering fuel discharge nozzle 50, situated generally within the throat 48 of venturi section 46, serves to discharge fuel, as is metered by the primary main metering system, into the induction passage means 34. A secondary main metering fuel discharge nozzle 51, situated generally within the throat 49 of venturi section 47, serves to discharge fuel, as is metered by the secondary main metering system, into the induction passage means 35.

Variably openable primary throttle valve means 52, carried as by a rotatable throttle shaft 54, serves to variably control the discharge and flow of combustible (fuel-air) mixtures into the inlet 44 of intake manifold 26. Suitable throttle control linkage means, as generally depicted at 56, is provided and operatively connected to throttle shaft 54 in order to affect throttle positioning in response to vehicle operator demand. The throttle valve, as will become more evident, also serves to vary the rate of fuel flow metered by the associated idle fuel metering system and discharged into the induction passage means.

Variably openable secondary throttle valve means 53, carried as by a rotatable shaft 55, serves to variably control the discharge and flow of combustible (fuel-air) mixtures into the inlet 45 of intake manifold 26. Suitable throttle control and linkage means, as generally depicted at 57, is provided and operatively connected as to associated actuator means 59. The actuator means 59 may be additional linkage means operatively interconnecting the secondary throttle valve means 53 with the primary throttle valve means 52 so that after such throttle valve means 52 are opened some preselected amount the secondary throttle valve means 53 are thereafter progressively opened, or, the actuator means 59 may be pressure (vaccum) responsive motor means effective for progressively opening the secondary throttle valve means 53 once a preselected minimum rate of air flow through the primary induction passage means 34 is attained. Many specific forms of such secondary actuator means are well known in the art and the practice of the invention is not limited to any specific embodiment of such actuator means 59.

Carburetor body means 32 may be formed as to also define a fuel reserovir chamber 58 adapted to contain fuel 60 therein the level of which may be determined as by, for example, a float operated fuel inlet valve assembly (not shown but generally well known in the art).

The primary main fuel metering system comprises passage or conduit means 62 communicating generally between fuel chamber 58 and a generally upwardly extending primary main fuel well 64 which, as shown, may contain a primary main well tube 66 which, in turn, is provided with a plurality of generally radially directed apertures 68 formed through the wall thereof as to thereby provide for communication as between the interior of the tube 66 and the portion of the well 64 generally radially surrounding the tube 66. Conduit means 70 serves to communicate between the upper part of well 64 and the interior of discharge nozzle 50. Air bleed type passage means 72, comprising conduit means 74 and calibrated restriction or metering means 76, communicates as between a source of filtered air and the upper part of the interior of well tube 66. A main calibrated metering restriction 78 is situated generally upstream of well 64, as for example in conduit means 62, in order to meter the rate of fuel flow from chamber 58 to main well 64. As is generally well known in the art, the interior of fuel reservoir chamber 58 is preferably pressure vented to a source of generally ambient air as by means of, for example, vent-like passage means 80 leading from chamber 58 as to the inlet end 36 of induction passage means 34.

The secondary main fuel metering system comprises passage or conduit means 63 communicating generally between fuel chamber 58 and a generally upwardly extending secondary main fuel well 65 which, as shown, may contain a secondary well tube 67 which, in turn, is provided with a plurality of generally radially directed apertures 69 formed through the wall thereof as to thereby provide for communication as between the interior of the tube 67 and the portion of the well 65 generally radially surrounding the tube 67. Conduit means 71 serves to communicate between the upper part of well 65 and the interior of discharge nozzle 51. Air bleed type passage means 73, comprising conduit means 75 and calibrated restriction or metering means 77, communicates as between a source of filtered air and the upper part of the interior of well tube 67. A secondary main calibrated fuel metering restriction 79 is situated generally upstream of well 65, for example in conduit 63, in order to meter the rate of fuel flow from chamber 58 to secondary main well 65.

Generally, when the engine is running, the intake stroke of each power piston causes air flow through the primary induction passage 34 and venturi throat 48. The air thusly flowing through the venturi throat 48 creates a low pressure commonly referred to as a venturi vacuum. The magnitude of such venturi vacuum is determined primarily by the velocity of the air flowing through the venturi and, of course, such velocity is determined by the speed and power output of the engine. The difference between the pressure in the venturi throat 48 and the air pressure within fuel reservoir chamber 58 causes fuel to flow from fuel chamber 58 through the primary main metering system. That is, the fuel flows through metering restriction 78, conduit means 62, up through well 64 and, after mixing with the air supplied by the main well air bleed means 72, passes through conduit means 70 and discharges from nozzle 50 into induction passage means 34. Generally, the calibration of the various controlling elements are such as to cause such main metered fuel flow to start to occur at some pre-determined differential between fuel reservoir and venturi pressure. Such a differential may exist, for example, at a vehicular speed of 30 m.p.h. at normal road load.

Engine and vehicle operation at conditions less than that required to initiate operation of the primary main metering system are achieved by operation of the idle fuel metering system, which may not only supply metered fuel flow during curb idle engine operation but also at off idle operation.

At curb idle and other relatively low speeds of engine operation, the engine does not cause a sufficient air flow through the venturi section 48 as to result in a venturi vacuum sufficient to operate the primary main metering system. Because of the relatively almost closed throttle valve means 52, which greatly restricts air flow into the intake manifold 26 at idle and low engine speeds, engine or intake manifold vacuum is of a relatively high magnitude. This high manifold vacuum serves to provide a pressure differential which operates the idle fuel metering system.

Generally, the idle fuel system is illustrated as comprising calibrated idle fuel restriction metering means 82 and passage means 83 communicating as between a source of fuel, as within, for example, the fuel well 64, and a generally upwardly extending passage or conduit 86 the lower end of which communicates with a generally laterally extending conduit 88. A downwardly depending conduit 90 communicates at its upper end with conduit 88 while at its lower end it communicates with induction passage means 34 as through aperture means 92. The effective size of discharge aperture 92 may be variably established as by an axially adjustable needle valve member 94 threadably carried by body 32. As generally shown and as generally known in the art, passage 88 may terminate in a relatively vertically elongated discharge opening or aperture 96 located as to be generally juxtaposed to an edge of throttle valve means 52 when such throttle valve 52 is in its curb-idle or nominally closed position. Often, aperture 96 is referred to in the art as being a transfer slot effectively increasing the area for flow of fuel to the underside of throttle valve 52 as the throttle valve is moved toward a more fully opened position.

Conduit means 98, provided with calibrated air metering or restriction means 100, serves to communicate as between an upper portion of conduit 86 and a source of atmospheric air as at the inlet end 36 of induction passage means 34.

At idle engine operation, the greatly reduced pressure area below the throttle valve means 52 causes fuel to flow as from the fuel reservoir 58 and well 64 through conduit means 83 and restriction means 82 and generally intermixes with the bleed air provided by conduit 98 and air bleed restriction means 100. The fuel-air emulsion then is drawn downwardly through conduit 86 and through conduits 88 and 90 ultimately discharged, posterior to throttle valve 52, through the effective opening of aperture 92.

During off-idle operation, the throttle valve means 52 is moved in the opening direction causing the juxtaposed edge of the throttle valve to further effectively open and expose a greater portion of the transfer slot or port means 96 to the manifold vacuum existing posterior to the throttle valve 52. This, of course, causes additional metered idle fuel flow through the transfer port means 96. As the throttle valve means 52 is opened still wider and the engine speed increases, the velocity of air flow through the induction passage 34 increases to the point where the resulting developed venturi 48 vacuum is sufficient to cause the hereinbefore described primary main metering system to be brought into operation.

During the early stage of primary main fuel metering system operation, the secondary throttle valve means 53 remain closed allowing the primary main fuel metering system to provide satisfactory fuel-air ratios and distribution thereof to the engine. However, when engine speed and load increases to a point where additional breathing (air flow) capacity is needed, the secondary throttle valve means 53 start to open by means of the associated actuating or actuator means 59. Generally, as further increases in fuel-air mixtures are needed the secondary throttle valve means 53 are accordingly further opened. During such periods of secondary throttle (operation) opening, the metered fuel supplied to the induction passage means 35 is supplied similarly to that of the primary main metered fuel. That is, the air flow through the secondary induction passage 35 and venturi throat 49 creates a secondary venturi vacuum and the difference between the pressure in the venturi throat 49 and the air pressure within fuel reservoir chamber 58 causes fuel to flow from fuel chamber 58 through the secondary main metering system. That is, the fuel flows through metering restriction 79, conduit means 63, up through well 65 and, after mixing with the air supplied by secondary main well air bleed means 73, passes through conduit means 71 and discharges from nozzle means 51 into induction passage means 35. Generally, the calibration of the various controlling elements are such as to cause such secondary main metered fuel flow to start to occur at some pre-determined differential between fuel reservoir and venturi throat 49 pressure.

The invention as herein disclosed and described provides means, in addition to those hereinbefore described, for controlling and/or modifying the metering characteristics otherwise established by the fluid circuit constants previously described. In the embodiment disclosed, among other cooperating elements, solenoid valving means 102 is provided to enable the performance of such modifying and/or control functions.

The solenoid valving means 102 is illustrated in greater detail in FIG. 3 and the detailed description thereof will hereinafter be presented in regard to the consideration of said FIG. 3. However, at this point, and still with reference to FIG. 2, it will be sufficient to point out that, in the embodiment disclosed, the solenoid means or assembly 102 has an operative upper end and an operative lower end and that such means or assembly 102 is carried by the carbureting body means as, for example, to be partly received by the fuel reservoir 58. As generally depicted in FIG. 2, the lower operative end of solenoid valving means or assembly 102 is operatively received as by an opening 104 formed as in the interior of fuel reservoir 58 with such opening 104 generally, in turn, communicating with passage means 106 leading to the main fuel well 64. In fact, as also depicted, the idle fuel passage 83 may communicate with primary main well 64 through a portion of such passage means 106 which is preferably provided with calibrated restriction means 108.

The carbureting means 28 may be comprised of an upper disposed body or housing section 110 provided as with a cover-like portion 112 which serves to in effect cover the fuel reservoir 58. As also depicted in FIG. 2, the upper end of solenoid assembly 102 may be generally received through cover section 112 as to have the upper end of assembly 102 received as by an opening 114 formed as within a cap-like housing or body portion 116 which has a relatively enlarged passage or chamber 118 formed therein and communicating with laterally extending passages or conduits 120 and 122 which, in turn, respectively communicate with illustrated downwardly extending passage or conduits 124 and 126. A conduit 128, formed in housing section 110, serves to interconnect and complete communication as between the lower end of conduit 124 and the upper end of conduit 86, while a second conduit 130, also formed in housing section 110, serves to interconnect and complete communication as between the lower end of conduit 126 and a source of ambient atmosphere as, preferably, at a point in the air inlet end of primary induction passage means 34. Such may take the form of an opening 132, communicating with passage means 34, situated generally downstream of choke or air valve means 38.

Figure 3:
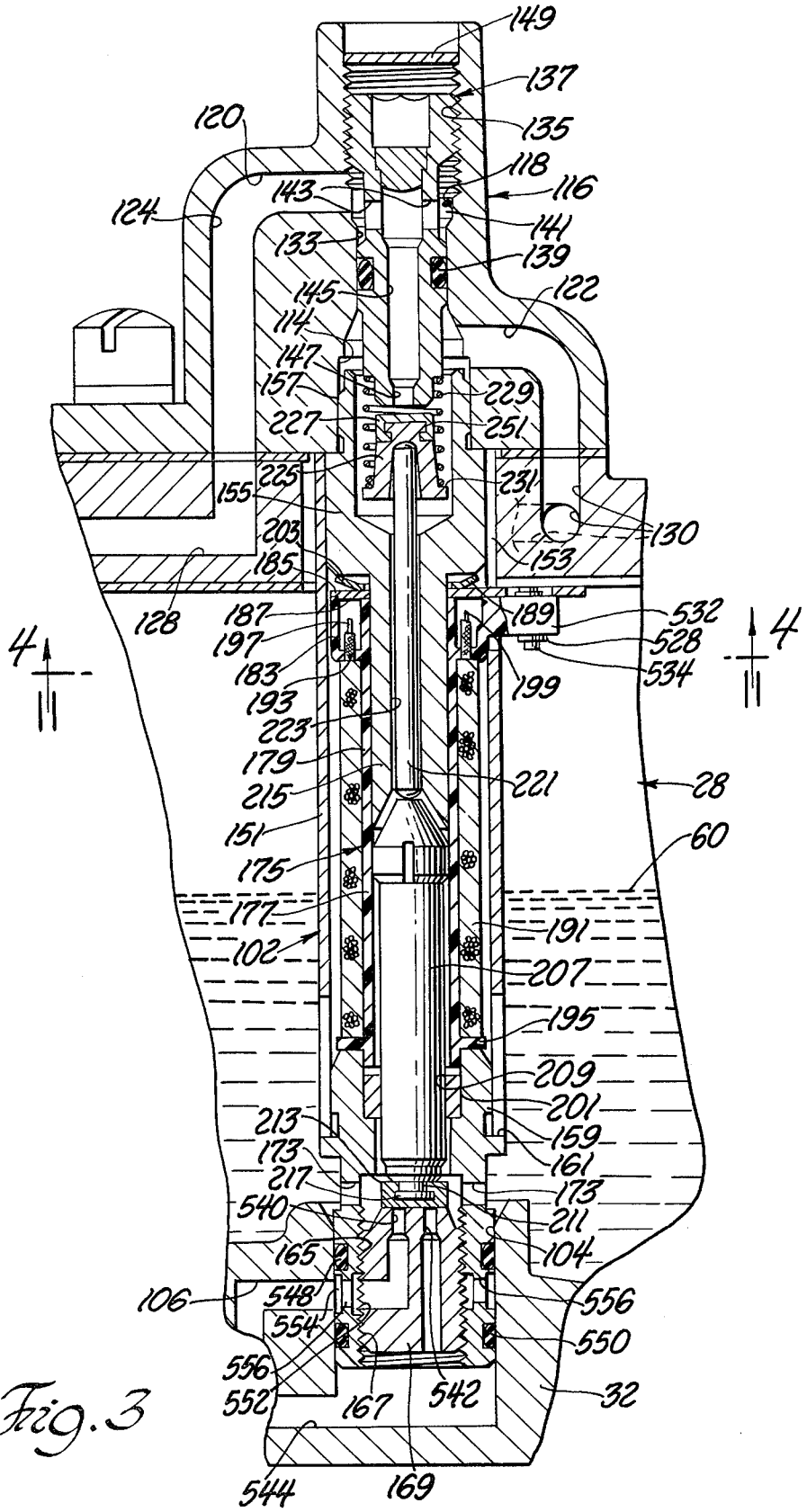
FIG. 3 is an enlarged axial cross-sectional view of one of the elements shown in FIG. 2 along with fragmentary portions of related structure also shown in FIG. 2.

Referring in greater detail to both FIGS. 2 and 3, and in particular to FIG. 3, chamber 118 of housing portion 116 is shown as having a cylindrical passage portion 133 with an axially extending section thereof being internally threaded as at 135 in order to threadably engage a generally tubular valve seat member 137 which has its inner-most end provided with an annular seal, such as an O-ring, 139 thereby sealing such inner-most end of member 137 against the surface of cylindrical passage portion 133. As depicted, valve seat member 137 is generally necked-down at its mid-section thereby providing for an annular chamber 141 thereabout with such annular chamber 141 being, of course, partly defined by a cooperating portion of chamber or passage means 118. A plurality of generally radially directed apertures or passages 143 serve to complete communication as between annular chamber 141 and an axially extending conduit 145, formed in the body of valve seat member 137, which, in turn, communicates with a valve seat calibrated orifice or passage 147. After the valve seat member 137 is threadably axially positioned in the selected relationship, a suitable chamber closure member 149 may be placed in the otherwise open end of chamber 118.

The solenoid assembly 102 is illustrated as comprising a generally tubular outer case 151 the upper end of which is slotted, as depicted at 153, and receives a generally stepped tubular solenoid sleeve member 155 which may be secured to the outer case or housing 151 as by, for example, having the member 155 pressed into the housing 151 and then further crimping housing 151 against member 155. The outer surface 157 of the upper end of sleeve member 155 is closely received within cooperating receiving opening 144.

A generally lower disposed end sleeve member 159 may be similarly received by the lower open end of case or housing 151 and suitably secured thereto as by, for example, crimping. Preferably, sleeve member 159 is provided with a flange portion 161 against which the end of case 151 may axially abut. The lower-most end of sleeve member 159 is closely received within cooperating opening or passage 104 and is provided with an annular groove or recess which, in turn, receives and retains a seal, such as, for example, an "O"-ring, 163 which serves to assure such lower-most portion of sleeve 159 being peripherally sealed against the surface of opening 104. A generally medially situated chamber 165, formed as in sleeve member 159, is preferably provided with an internally threaded portion 167 which threadably engages a threadably axially adjustable valve seat member 169. The valve seat member 169 is provided with calibrated valve orifice or passageway means 540 and 542 with passageway 540 being effective for communicating as between chamber 165 and passage or conduit means 106 while passageway 542 communicates as between chamber 165 and passage or conduit means 544 leading to secondary main well 65. As illustrated in FIG. 2, passage means 544 may comprise calibrated restriction means 546. A plurality of generally radially directed apertures or passages 173 serve to complete communication as between chamber 165 and the interior of the fuel reservoir 58.

A spool-like member 175 has an axially extending cylindrical tubular portion 177 the upper portion 179 of which is closely received about the tubular extension portion 215 of solenoid sleeve 155. Near the upper end of spool member 175, such member is provided with a generally cylindrical cup-like portion 183 which, in turn, defines an upper disposed abutment or axial end mounting surface 185 which abuts as against a flat insulating member 187. An annular bowed spring 203 is axially contained between member 187 and the shoulder or flange portion 189 of end member 155 as to thereby resiliently urge such away from each other. An electrical coil or winding 191, carried generally about tubular portion 177 and between axial end walls 193 and 195 of spool 175, may have its leads 197 and 199 pass as through wall portion 193 for connection to related circuitry, to be described.

A cylindrical armature 207, slidably reciprocatingly received within tubular portion 177 of bobbin 175 and aligned passageway 209, formed as in a bushing member 201 situated in sleeve member 159, has a lower disposed axial extension 211 and an integrally formed annular flange-like portion 217 which internally engage and both laterally and axially retain a related, preferably at least somewhat resilient, generally cup-like valve member 213.

Somewhat similarly, the upper end of armature 207 is in operative abutting engagement with an axial extension, such as a pin or rod 221 which passes through a clearance passageway 223, formed in upper sleeve member 155 (including its tubular extension 215 received with tubular portion 177 of spool 175), and abutably engages an upper disposed valving member 225 which is provided with an axial extension 219 and intergrally formed annular flange 251 which internally engage and laterally and axially retain, preferably at least a somewhat resilient, generally cup-like valve member 227. A compression spring 229 has one end seated as against valve seat member 137 and its other end seated against a suitable flange portion 231 of valving member 225 as to thereby normally yieldingly urge the valve member 227 and armature 207 axially away from the valve seat member 137 (that being the opening direction for valve passageway 147).

As should be apparent, upon energization and deenergization of the coil 191, armature 207 will experience reciprocating motion with the result that, in alternating fashion, valve member 227 will close and open calibrated passageway 147 while valve member 213 will open and close calibrated passageways 540 and 542.

Without, at this point, considering the overall operation, it should now be apparent that when, for example, armature 207 is in its upper-most position and valve member 227 has fully closed passageway or orifice 147, all communication between conduits 120 and 122 is terminated. Therefore, the only source for any bleed air, to be mixed with raw or solid fuel being drawn through conduit means 83 (to thereby create the fuel-air emulsion previously referred to herein), is through bleed air passage 98 and calibrated bleed air restriction means 100 (FIG. 2). The ratio of fuel-to-air in such an emulsion (under such an assumed condition) will be determined by the restrictive quality of air bleed restriction means 100, alone.

However, let it be assumed that armature 207 has moved to its lower-most position, as depicted, and that valve member 227 has, thereby fully opened calibrated passageway 147. Under such an assumed condition, it can be seen that communication, via passage or orifice 147, is completed as between conduits 120 and 122 with the result that now, the top of conduit 86 (FIG. 2) is in controlled (by virtue of the restrictive qualities or characteristics occurring at passageway 147) communication with a source of ambient atmosphere via conduits 128, 124, 120, 143, 145, 147, 122, 126 and 130 and opening 132 (FIG. 2). Accordingly, it can be seen that under such an assumed condition the source for bleed air, to be mixed with raw or solid fuel being drawn through conduit means 83 (to thereby create the fuel-air emulsion hereinafter referred to), is through both bleed air passage 98 and restriction means 100 as well as conduit means 130 as set forth above. Therefore, it can be readily seen that under such an assumed condition significantly more bleed-air will be available and the resulting ratio of fuel-to-air in such an emulsion will be accordingly significantly leaner (in terms of fuel) than the fuel-to-air ratio obtained when only conduit 98 and restriction 100 were the sole source for bleed air.

Obviously, the two assumed conditions discussed above are extremes and an entire range of conditions exist between such extremes. Further, since the armature 207 and valve member 227 will, during operation, intermittently reciprocatingly open and close passageway or orifice 147, the percentage of time, within any selected unit or span of time used as a reference, that the orifice 147 is opened will determine the degree to which such variably determined additional bleed air becomes available for intermixing with the said raw or solid fuel.

Generally, and by way of summary, with proportionately greater rate of flow of idle bleed air, the less, proportionately, is the rate of metered idle fuel flow thereby causing a reduction in the richness (in terms of fuel) in the fuel-air mixture supplied through the primary induction passage means 34 and into the intake manifold 26. The converse is also true; that is, as aperture or orifice means 147 is more nearly totally, in terms of time, closed, the total rate of idle bleed air becomes increasingly more dependent upon the comparatively reduced effective flow area of restriction means 100 thereby proportionately reducing the rate of idle bleed air and increasing, proportionately, the rate of metered idle fuel flow and, thereby, resulting in an increase in the richness (in terms of fuel) in the fuel-air mixture supplied through primary induction passage means 34 and into the intake manifold 26.

Further, and still without considering the overall operation of the invention, it should be apparent that for any selected metering pressure differential between the venturi vacuum, $P_v$, and the pressure, $P_a$, within reservoir 58, the "richness" of the fuel delivered by the main fuel metering system can be modulated merely by the moving of valve member 213 toward and/or away from coacting aperture or passage means 540 and 542. That is, considering for the moment only calibrated passage means 540, for any such given metering pressure differential, the greater the effective opening of aperture 540 becomes, the greater also becomes the rate of metered fuel flow since one of the factors controlling such rate is the effective area of the metering orifice means. Obviously, in the embodiment disclosed, the effective flow area of orifice means 540 is fixed; however, the effectiveness of flow permitted therethrough is related to the percentage of time, within any selected unit or span of time used as a reference, that the orifice means 540 is opened (valve member 213 being moved away from passage means 540) thereby permitting an increase in the rate of fuel flow through passages 173, 165, 540 and 106 to primary main fuel well 64 (FIG. 2). With such opening of orifice means 540 it can be seen that the metering area of orifice means 540 is, generally, additive to the effective metering area of orifice means 78. Therefore, a comparatively increased rate of metered fuel flow is consequently discharged, through nozzle 50, into the primary induction passage means 34. The converse is also true; that is, the less that orifice means 540 is effectively open or opened, the total effective main fuel metering area effectively decreases and approaches that effective area determined by metering means 78. Consequently, the total rate of metered main fuel flow decreases and a comparatively decreased rate of metered fuel flow is discharged through nozzle 50 into the primary induction passage means 34.

Similarly, it should be apparent that for any selected metering pressure differential between the venturi throat 49 vacuum, $P_{v2}$, and the pressure, $P_a$, within reservoir 58, the "richness" of the fuel delivered by the secondary main fuel metering system is also modulated merely by the moving of valve member 213 toward and/or away from coacting aperture or passage means 542. That is, for any such given metering pressure differential, the greater the effective opening of aperture 542 becomes, the greater also becomes the rate of metered fuel flow since one of the factors controlling such rate is the effective area of the metering orifice means. Obviously, in the embodiment disclosed, the effective flow area of orifice means 542 is fixed; however, the effectiveness of flow permitted therethrough is related to the percentage of time, within any selected unit or span of time used as a reference, that the orifice means 542 is opened (valve member 213 being moved away from passage means 542) thereby permitting an increase in the rate of fuel flow through passages 173, 165, 542 and 544 to secondary main well 65 (FIG. 2). With such opening of orifice means 542 it can be seen that the metering area of orifice means 542 is, generally, additive to the effective metering area of orifice means 79. Therefore, a comparatively increased rate of metered fuel flow is consequently discharged, through nozzle 51, into the secondary induction passage means 35. The converse is also true; that is, the less that orifice means 542 is effectively open or opened, the total effective main fuel metering area effectively decreases and approaches that effective area determined by metering means 79. Consequently, the total rate of metered secondary main fuel flow decreases and a comparatively decreased rate of metered secondary fuel flow is discharged through nozzle means 51 into the secondary induction passage means 35.

As should be apparent, when valve member 213 is moved in the opening direction, both orifice or passage means 540 and 542 are simultaneously opened.

It might be best to point out that in the embodiment disclosed, as best shown in FIG. 3, the lower tubular extension is provided with axially spaced annular grooves for the respective reception of sealing means, such as O-rings 548 and 550. Generally axially between such respective grooves and seals, the extension is preferably provided with an internally formed annular groove or recess 552 and an externally formed annular groove or recess 554 which are brought into fluid communication with each other as by a plurality of generally radially extending apertures or passageways 556. The provision of such annular recesses 552 and 554 assure communication as between conduit or passage means 540 and conduit means 106 regardless of the relative assembled positions of member 159, housing portion 32 and valve seat member 169.

FIG. 1 further illustrates suitable logic control means 160 which may be electrical logic control means having suitable electrical signal conveying conductor means 162, 164, 166 and 168 leading thereto for applying electrical input signals, reflective of selected operating parameters, to the circuitry of logic means 160. It should, of course, be apparent that such input signals may convey the required information in terms of the magnitude of the signal as well as conveying information by the presence of absence of the signal itself. Output electrical conductor means, as at 197 and 199, serve to convey the output electrical control signal from the logic means 160 to the associated electrically-operated control valve means 102. A suitable source of electrical potential 174 is shown as being electrically connected to logic means 160.

In the embodiment disclosed, the various electrical conductor means 162, 164, 166 and 168 are respectively connected to parameter sensing and transducer signal producing means 178, 180 and 812. In the embodiment shown, the means 178 comprises oxygen (or other exhaust gas constituent) sensor means communicating with exhaust conduit means 22 at a point generally upstream of a catalytic converter 184. The transducer means 180 may comprise electrical switch means situated as to be actuated by cooperating lever means 186 fixedly carried as by the throttle shaft 54, and swingably rotatable therewith into the out of operating engagement with switch means 180, in order to thereby provided a signal indicative of the throttle 52 having attained a preselected position.

The transducer 182 may comprise suitable temperature responsive means, such as, for example, theremocouple means, effective for sensing engine temperature and creating an electrical signal in accordance therewith.

Figure 6:
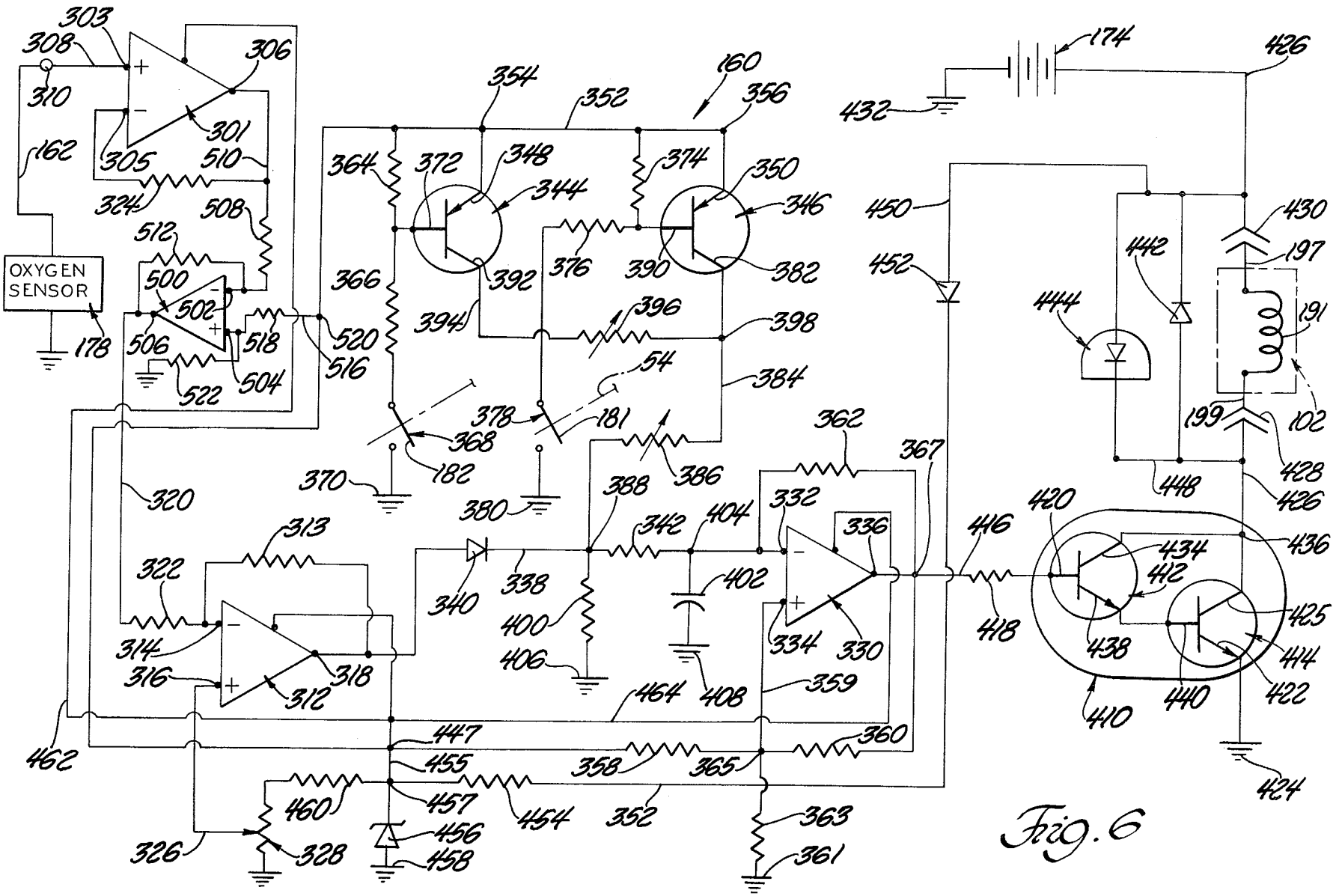
FIG. 6 is a schematic wiring diagram of circuitry employable in association with the invention.

FIG. 6 illustrates, by way of example, a form of circuitry employable as the logic circuitry 160 of FIG. 1. Referring now in greater detail to FIG. 6, such embodiment of the control and logic circuit means 160 is illustrated as comprising a first operational amplifier 301 having input terminals 303 and 305 along with output terminal means 306. Input terminal 303 is electrically connected as by conductor means 308 and a connecting terminal 310 as to output electrical conductor means 162 leading from the oxygen sensor 178. Although the invention is not so limited, it has, nevertheless, been discovered that excellent results are obtainable by employing an oxygen sensor assembly produced commerically by the Electronics Division of Robert Bosch GmbH of Schwieberdingen, Germany and as generally illustrated and described on pages 137–144 of the book entitled "Automotive Electronics II" published February 1975, by the Society of Automotive Engineers, Inc., 400 Commonwealth Drive, Warrendale, Pa., bearing U.S.A. copyright notice of 1975, and further identified as SAE (Society of Automotive Engineers, Inc.) Publication No. SP-393. Generally, such an oxygen sensor comprises a ceremic tube or cone of zirconium dioxide doped with selected metal oxides with the inner and outer surfaces of the tube or cone being coated with a layer of platinum. Suitable electrode means are carried by the ceramic tube or cone as to thereby result in a voltage thereacross in response to the degree of oxygen present in the exhaust gases flowing by the ceramic tube. Generally, as the presence of oxygen in the exhaust gases decreases, the voltage developed by the oxygen sensor decreases.

An inverting amplifier means 500 having input terminal means 502 and 504 and output terminal means 506 has its input terminal 502 electrically connected as via resistance means 508 and conductor means 510 to output means 306 while the output 506 thereof is electrically connected as to conductor means 320. Feedback resistance means 512 is shown as being connected electrically across input terminal 502 and output means 506. Input terminal means 504 is electrically connected as through conductor means 516 and resistance means 518 to a conductor 352 as at 520. Additional resistance means 522 is shown as also being electrically connected at one end to input terminal 504 and, at its other end, to ground.

A second operational amplifier 312 has input terminals 314 and 316 along with output terminal means 318. Inverting input terminal 314 is electrically connected as by conductor means 320 and resistor means 322 to the output 506 of amplifier 500. Amplifier 301 has its inverting input 305 electrically connected via feedback circuit means, comprising resistor 324, electrically connected to the output 306 as by conductor means 510. The input terminal 316 of amplifier 312 is connected as by conductor means 326 to potentiometer means 328.

A third operational amplifier 330, provided with input terminals 332 and 334 along with output terminal means 336, has its inverting input terminal 332 electrically connected to the output 318 of amplifier 312 as by conductor means 338 and diode means 340 and resistance means 342 serially situated therein.

First and second transistor means 344 and 346 each have their respective emitter terminals 348 and 350 electrically connected, as at 354 and 356, to conductor means 352 leading to the conductor means 455 as at 447. A resistor 358, has one end connected to conductor 455 and its other resistor end connected to conductor 359 leading from input terminal 334 to ground 361 as through a resistor 362. Further, a resistor 360 has its opposite ends electrically connected as at points 365 and 367 to conductors 359 and 416. A feedback circuit, comprising resistance means 362, is placed as to be electrically connected to the output and input terminals 336 and 332 of amplifier 330.

A voltage divider network, comprising resistor means 364 and 366, has one electrical end connected to conductor means 352 as at a point between 354 and resistor 358. The other electrical end of the voltage divider is connected as to switch means 368 which, when closed, completes a circuit as to ground at 370. The base terminal 372 of transistor 344 is connected to the voltage divider as at a point between resistors 364 and 366.

A second voltage divider network comprising resistor means 374 and 376 has one electrical end connected to conductor means 352 as at a point between 354 and 356. The other electrical end of the voltage divider is connected as to second switch means 378 which, when closed, completes a circuit as to ground at 380. The base terminal 390 of transistor 346 is connected to the voltage divider as at a point between resistors 374 and 376.

Collector electrode 382 of transistor 346 is electrically connected as by conductor means 384 and serially situated resistor means 386 (which, as shown, may be variable resistance means), to conductor means 338 as at a point 388 generally between diode 340 and resistor 342. Somewhat similarly, the collector electrode 392 of transistor 344 is electrically connected, as by conductor means 394 and serially situated resistor means 396 (which, as shown, may also be a variable resistance means), to conductor means 384 as at a point 398 generally between collector 382 and resistor 386.

As also shown, resistor and capacitor means 400 and 402 have their respective one electrical ends or sides connected to conductor means as at points 388 and 404 while their respective other electrical ends are connected to ground as at 406 and 408. Point 404 is, as shown, generally between input terminal 332 and resistor 342.

A Darlington circuit 410, comprising transistors 412 and 414, is electrically connected to the output 336 of operational amplifier means 418 being electrically connected to the base terminal 420 of transistor 412. The emitter electrode 422 of transistor 414 is connected to ground 424 while the collector 425 thereof is electrically connected as by conductor means 426 connectable, as at 428 and 430, to the related solenoid actuated fuel metering means 102, and leading to the related source of electrical potential 174 grounded as at 432.

The collector 434 of transistor 412 is electrically connected to conductor means 426, as at point 436, while the emitter 438 thereof is electrically connected to the base terminal 440 of transistor 414.

Preferably, a diode 442 is placed in parallel with solenoid means 102 and a light-emitting-diode 444 is provided to visually indicate the condition of operation. Diodes 442 and 444 are electrically connected to conductor means 426 as by conductors 446 and 448.

Conductor means 450, connected to source 174 as by means of conductor 446 and comprising serially situated diode means 452 and resistance means 454, is connected to conductor means 455, as at 457, leading generally between amplifier 312 and one side of a zener diode 456 the other side of which is connected to ground as at 458. Additional resistance means 460 is situated in series as between potentiometer 328 and point 457 of conductor 455. Conductor 455 also serves as a power supply conductor to amplifier 312; similarly, conductor 462 and 464, each connected as to conductor means 455, serve as power supply conductor means to operational amplifier 301 and 330, respectively.

OPERATION OF THE INVENTION

Generally, the oxygen sensor 178 senses the oxygen content of the exhaust gases and, in response thereto, produces an output voltage signal which is proportional or otherwise related thereto. The voltage signal is then applied, as via conductor means 162, to the electronic logic and control means 160 which, in turn, compares the sensor voltage signal to a bias or reference voltage which is indicative of the desired oxygen concentration. The resulting difference between the sensor voltage signal and the bias voltage is indicative of the actual error and an electrical error signal, reflective thereof, is employed to produce a related operating voltage which is ultimately applied to the solenoid valving means 102 as by conductor means schematically shown at 197 and 199.

Figure 5:
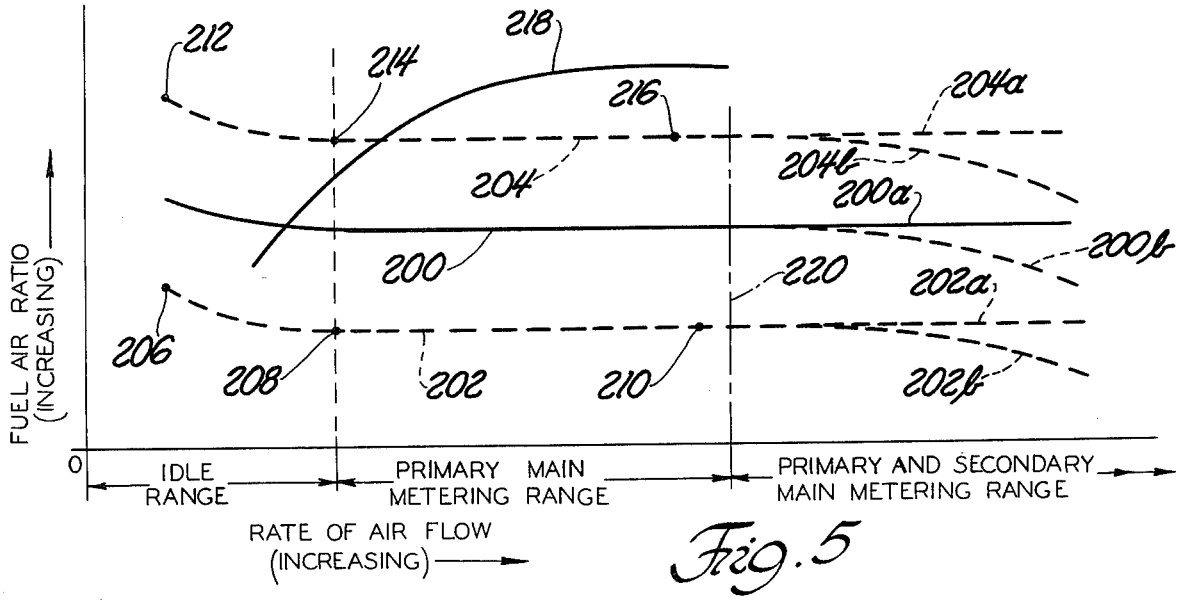
FIG. 5 is a graph illustrating, generally, fuel-air ratio curves obtainable with structures employing teachings of the invention.

The graph of FIG. 5 generally depicts fuel-air ratio curves obtainable by the invention. For purposes of illustration, let it be assumed that curve 200 represents a combustible mixture, metered as to have a ratio of 0.068 lbs. of fuel per pound of air. Then, as generally shown, the carbureting device 28, and more specifically the primary induction and fuel metering portion thereof, could provide a flow of combustible mixtures in the range anywhere from a slected lower-most fuel-air ratio as depicted by curve 202 to an uppermost fuel-air ratio as depicted by curve 204. As should be apparent, the invention is capable of providing an infinite family of such fuel-air ratio curves between and including curves 202 and 204. This becomes especially evident when one considers that the portion of curve 202 generally between points 206 and 208 is achieved when valving member 227 of FIG. 3 is moved as to more fully effectively open orifice 147, to its maximum intended effective opening, and cause the introduction of a maximum amount of bleed air therethrough. Similarly, that portion of curve 202 generally between points 208 and 210 is achieved when valve member 213 of FIG. 3 is moved downwardly as to thereby close orifice 540 to its intended minimum effective opening (or totally effectively closed) and cause the flow of fuel therethrough to be terminated or reduced accordingly.

In comparison, that portion of curve 204 generally between points 212 and 214 is achieved when valving member 227 of FIG. 3 is moved as to more fully effectivley close 147 to its intended minimum effective opening (or totally effectively closed) and cause the flow of bleed air therethrough to be terminated or reduced accordingly. Similarly, that portion of curve 204 generally between points 214 and 216 is achieved when valve member 213 is moved upwardly as to thereby open orifice 540 to its maximum intended opening and cause a corresponding maximum flow of fuel therethrough.

It should be apparent that the degree to which orifices 147 and 540 are respectively effectively opened, during actual operation, depends on the control signal produced by the logic control means 160 and, of course, the control signal thusly produced by means 160 depends, basically, on the input signal obtained from the oxygen sensor 178, as compared to the previously referred-to bias or reference signal. Accordingly, knowingwhat the desired composition of the exhaust gas from the engine should be, it then becomes possible to program the logic of means 160 as to create signals indicating deviations from such desired composition as to in accordance therewith modify the effective opening of orifices 147 and 540 to increase and/or decrease the richness (in terms of fuel) of the fuel-air mixture being metered to the engine through the idle or primary main metering systems. Such changes or modifications in fuel richness, of course, are, in turn, sensed by the oxygen sensor 178 which continues to further modify the fuel-air rotio of such metered mixture until the desired exhaust composition is attained. Accordingly, it is apparent that the system disclosed defines a closed-loop feedback system which continually operates to modify the fuel-air ratio of a metered combustible mixture assuring such mixture to be of a desired fuel-air ratio for the then existing operating parameters.

It is also contemplated, at least certain circumstances that the upper-most curve 204 may actually be, for the most part, effectively below a curve 218 which, in this instance, is employed to represent a hypothetical curve depicting the best fuel-air ratio of a combustible mixture for obtaining maximum power from engine 10, as during wide open throttle (WOT) operation. In such a contemplated contingency, transducer means 180 (FIG. 1) may be adapted to be operatively engaged, as by lever means 186, when throttle valve 52 has been moved to WOT condition. At that time, the resulting signal from transducer means 180, as applied to means 160, causes logic means 160 to appropriately respond by further altering the effective opening of orifices 147 and 540. That is, if it is assumed that curve portion 214–216 is obtained when orifice means 540 is effectively opened to a degree less than its maximum effective opening, then further effective openingthereof may be accomplished by causing a proportionately longest (in terms of time) opening movement of valve member 213. During such phase of operation, the metering becomes an open loop function and the input signal to logic means 160 provided by oxygen sensor 178 is, in effect, ignored for so song as the WOT signal from transducer 180 exists.

Similarly, in certain engines, because of any of a number of factors, it may be desirable to assure a lean (in terms of fuel richness) base fuel-air ratio enriched (by the well known choke mechanism) immediately upon starting of a cold engine. Accordingly, engine temperature transducer means 182 may be employed for producing a signal, over a predetermined range of low engine temperatures, and applying such signal to logic control means 160 as to thereby cause such logic means 160 to, in turn, produce and apply a control signal, via 197 and 199 to solenoid fuel valving means 102 as to cause the resulting fuel-air ratio of the metered combustible mixture to be, for example, in accordance with curve 202 of FIG. 5 or some other selected relatively "lean" fuel-air ratio.

Further, it is contemplated that at certain operating conditions and with certain oxygen sensors it may be desirable or even necessary to measure the temperature of the oxygen sensor itself. Accordingly, suitable temperature transducer means, as for example, thermocouple means well known in the art, may be employed to sense the temperature of the operating portion of the oxygen sensor means and provide a signal in accordance or in response thereto as via conductor means 164 to the electronic control means 160. That is, it is anticipated that it may be necessary to measure the temperature of the sensory portion of the oxygen sensor 178 to determine that such sensor 178 is sufficiently hot to provide a meaningful signal with respect to the composition of the exhaust gas. For example, upon re-starting a generally hot engine, the engine temperature and engine coolant temperature could be normal (as sensed by transducer means 182) and yet the oxygen sensor 178 could still be too cold and therefore not capable of providing a meaningful signal, of the exhaust gas composition, for several seconds after such re-start. Because a cold catalyst cannot clean-up from a rich mixture, it is advantageous, during the time that sensor means 178 is thusly too cold, to provide a relatively "lean" fuel-air ratio mixture. The sensor means 178 temperature signal thusly provided along conductor means 164 may serve to cause such logic means 160 to, in turn, produce and apply a control signal, as via 197 and 199 to solenoid valving means 102, the magnitude of which is such as to cause the resulting fuel-air ratio of the metered combustible mixture to be, for example, in accordance with curve 202 of FIG. 5 or some other selected relatively "lean" fuel-air ratio.

Referring in greater detail to FIG. 6 and the logic circuitry illustrated therein, the oxygen sensor 178 produces a voltage input signal along conductor means 162, terminal 310 and conductor means 308 to the input terminal 303 of operational amplifief 301. Such input signal is a voltage signal indicative of the degree of oxygen present in the exhaust gases and sensed by the sensor 178.

Amplifier 301 is employed as a buffer and preferably has a very high input impendence. The output voltage at output 306 of amplifier 301 is the same magnitude, relative to ground, as the output voltage of the oxygen sensor 178. Accordingly, the output at terminal 306 follows the output of the oxygen sensor 178.

The output of amplifier 301 is applied via conductor means 510 to the inverting input terminal 502 of inverting amplifier 500. Feedback resistor 512 causes amplifier 500 to have a preselected gain, the slope of which is determined by the resistance value of resistor 512 divided by the resistance value of resistor 508, so that the resulting amplified output at terminal 506 is applied via conductor means 320 to the inverting input 314 of amplifier 312. The reference signal as applied to input terminal 504 is determined by the value of the product of the resistance value of resistor 522 multiplied by the value of the voltage in conductor 352, divided by the sum of the resistance values of resistors 518 and 522. Feedback resistor 313 causes amplifier 312 to have a preselected gain so that the resulting amplified output at terminal 318 is applied via conductor means 338 to the inverting input 332 of amplifier 330. Generally, at this time it can be seen that if the signal on input 502 goes negative (−) then the output at terminal 506 will go positive (+) and that if the signal on input 314 goes positive (+) then the output at terminal 318 will go negative (−) and the output at 336 of amplifier 330 will go positive (+).

The input 316 of amplifier 312 is connected as to the wiper of potentiometer 328 in order to selectively establish a set-point or a reference point bias for the system which will then represent the desired or reference value of fuel-air mixture and to then be able to sense deviations therefrom by the value of the signal generated by sensor 178.

Switch means 368, which may comprise the transducer switching (or equivalent structure) means 182, when closed, as when the engine is below some preselected temperature, causes transistor 344 to go into conduction thereby establishing a current flow through the emitter 348 and collector 392 thereof and through resistor means 396, point 388 and through resistor 400 to ground 406. The same happens when, for example, switch means 378, which may comprise the throttle operated switch 181, is closed during WOT operation. During such WOT conditions (or ranges of throttle opening movement) it is transistor 346 which becomes conductive. In any event, both transistors 344 and 346, when conductive, cause current flow into resistor 400.

An oscillator circuit comprises resistor 342, amplifier 330 and capacitor 402. When voltage is applied as to the left end of resistor 342, current will flow through such resistor 342 and tend to charge-up capacitor 402. If it is assumed, for purposes of discussion, that the potential of the inverting input 332 is for some reason lower than that of the non-inverting input 334, the output of the operational amplifier at 336 will be relatively high and near or equal to the supply voltage of all of the operational amplifiers as derived from the zener diode 456. Consequently, current will flow as from point 367 through resistor 360 to point 365 and conductor 359, leading to the non-inverting input 334 of amplifier 330, and through resistor 363 to ground at 361. Therefore, it can be seen that when amplifier 330 is conductive, there is a current component through resistor 360 tending to increase the voltage drop across resistor 363.

As current flows from resistor 342, capacitor 402 undergoes charging and such charging continues until its potential is the same as that of the non-inverting input 334 of amplifier 330. When such potential is attained, the magnitude of the output at 336 of operational amplifier 330 is placed at a substantially ground potential and effectively places resistor 360 to ground. Therefore, the magnitude of the voltage at the non-inverting input terminal 334 suddenly drops and the inverting input 332 suddenly becomes at a higher potential than the non-inverting input 334. At the same time, resistor 362 is also effectively brought to ground thereby tending to discharge the capacitor 402.

The capacitor 402 will then discharge thereby decreasing in potential and approaching the now reduced potential of the non-inverting input 334. When the potential of capacitor 402 equals the potential of the non-inverting input 334 then the output 36 of amplifier 330 will suddenly go to its relatively high state again and the potential of the non-inverting input 334 suddenly becomes a much higher potential than the discharged capacitor 402.

The preceding oscillating process keeps repeating.

The ratio of "on" time to "off" time of amplifier 330 depends on the voltage at 388. When that voltage is high, capacitor 402 will charge very quickly and discharge slowly, and amplifier 330 output will stay low for a long period. Conversely, when voltage at 388 is low, output of amplifier 330 will stay high for a long period.

The consequent signal generated by the turning "on" and turning "off" of amplifier 330 is applied to the base circuit of the Darlington circuit 410. When the output of amplifier 330 is "on" or as previously stated relatively high, the Darlington 410 is made conductive thereby energizing winding 191 of the solenoid valving assembly 102. Diode 442 is provided to suppress high voltage transients as may be generated by winding 191 while the LED 444 may be employed, if desired, to provide visual indication of the operation of the winding 191.

As should be evident, the ratio of the "on" or high output time of amplifier 330 to the "off" or low output time of amplifier 330 determines the relative percentage or portion of the cycle time, or duty cycle, at which coil 191 is energized thereby directly determining the effective orifice opening of orifice 540.

Let it be assumed, for purposes of description, that the output of oxygen sensor 178 has gone positive (+) or increased meaning that the fuel-air mixture has become enriched (in terms of fuel). Such increased voltage signal is applied to input terminal 502 of inverter means 500 and the output 506 of inverter amplifier 500 drops in voltage because of the inverting of input 502. The output 506 applied to input 314 of amplifier 312 causes the output at 318 thereof to increase because of the inverting of input 314. Because of this increased voltage is applied to the resistor 342 and therefore it takes less time to charge up capacitor 402. Consequently, the ratio of the "on" or high output time to the "off" or low output time of amplifier 330 decreases. This ultimately results in applying less average current to the coil 191 which, in turn, means that, in terms of percentage of time, valving orifice 147 is opened longer while valving orifice 540 is closed longer thereby reducing the rate of metered fuel flow through both the primary main and idle fuel systems.

It should now also become apparent that with either or both switch means 368 and 378 being closed a greater voltage is applied to resistor 342 thereby reducing the charging time of the capacitor 402 with the result, as previously described, of altering the ratio of the "on" time to "off" time of amplifier 330.

When current, as through Darlington 440, is applied to coil or winding 191 of FIG. 3, the resulting magnetic field moves armature 207 and valving members 213 and 227 upwardly (for a proportionately longer period of time), as viewed in FIG. 3, causing valve member 227 to sealingly seat against valve seat member 137 and thereby, at that moment, terminate any communication as between passages 147 and 122. At the same time, the upward movement of valve 213 permits communication to be established, through orifice means 540, between passage 106 and chamber 165. When the current through Darlington 440 is terminated, as during periods when the output of amplifier 330 is low or "off", the magnetic field created by the winding 191 ceases to exist and spring 229 moves armature 207 and valve members 213 and 227 downwardly causing valve member 213 to effectively sealingly seat against valve seat 169 to terminate communication through orifice means 540. At the same time, the downward movement of valve member 227 permits communication to be established, through orifice means 147, as between passage means 145 and 130. Accordingly, it can be seen that, generally, when excess fuel richness is sensed (or amplifier 330 is "off"), communication as between passage 106 and chamber 165 is terminated while communication between passages 120 and 122 is completed. Likewise, generally, when an insufficient rate of fuel is being supplied and senses (or amplifier 330 is "on") communication as between passage 106 and chamber 165 is completed while communication between passages 120 and 122 is terminated.

In the invention, it can be seen, that upon failure of the related electrical system, the fuel-air ratio of the fuel mixture metered to the engine would become "lean", in terms of fuel. That is, the fuel-air ratio would become a preselected "leanest" ratio because the maximum rate of bleed air would be bled into the idle fuel metering system via open orifice means 147 while the minimum rate of main fuel would be metered by the main fuel system because passage means 540 and 542 would be closed and the respective parallel main metering restrictions 78 and 79 (FIG. 1) would be open.

Figure 4:
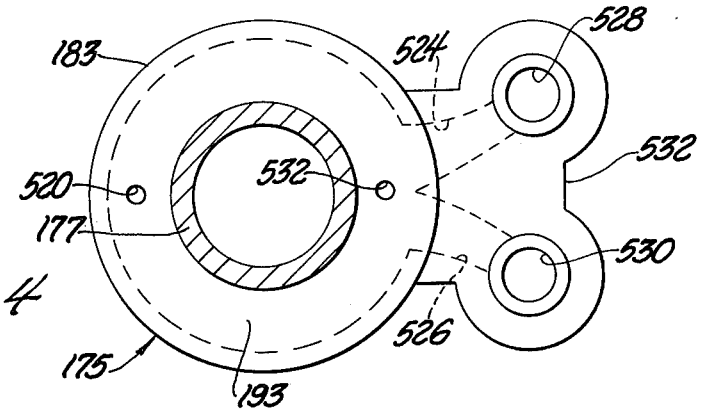
FIG. 4 is a cross-sectional view taken generally on the plane of line 4—4 of FIG. 3 and looking in the direction of the arrows.

Although various arrangements are, of course, possible, in the preferred embodiment the coil leads 197 and 199 (FIG. 3) may pass through suitable clearance or passage means 520 and 522 (FIG. 4) and pass through relieved portions 524, 526 (formed in integrally formed arm portion 532) and then be respectively received as within eyelets 528, 530 which also respectively receive enlarged conductor extensions of such leads 197 and 199 (one of such being partly depicted at 534 in FIG. 3). Such extensions may, of course, be brought out of the carburetor housing means in any suitable manner as to thereby, in effect, comprise the conductor means 197 and 199 as depicted in FIGS. 1 and 6.

As was already stated, when valve member 213 is moved away from passage means 540, passage means 542 is simultaneously opened. Therefore, generally, as the valve member 213 serves to make available an increase in the rate of primary main fuel flow through passage means 540, it also serves to make available an increase in the rate of secondary main fuel flow through passage means 542. Further, as was described in the preferred embodiment, the carbureting structure disclosed is staged so that the secondary throttle valve means 53 are progressively opened only after the primary throttle valve means 52 have opened to accommodate a particular condition of engine load and speed. Now referring again to FIG. 5, if it is assumed, for purposes of description, that the secondary throttle valve means 53 start to open at a condition of engine operation depicted by line 220, then it becomes evident that during engine operating conditions to the left (as viewed in FIG. 5) of line 220, the secondary throttle valve means 53 will be closed and there will be either no or at least an insufficient rate of air flow through the secondary induction passage means 35 to create a venturi throat 49 bacuum of a magnitude sufficient to cause fuel to flow out of well 65, through passage 71 and nozzle 51 into the induction passage means 35. Therefore, even though the modulating valving means 102 may be operating as to provide a rate of metered fuel flow corresponding to, for example, curve 204 of FIG. 5 (and thereby also more fully effectively opening passage 542), no secondary main metering fuel flow is experienced through either passage means 542 or passage means 63 because of the absence of the required metering pressure differential.

However, once the engine is operating at conditions generally represented to the right (as viewed in FIG. 5) of line 220, the velocity rate of air flow (due to the opening movement of the secondary throttle valve means 53) through the secondary induction passage means 35 becomes sufficient to, in turn, create a venturi throat 49 vacuum of a magnitude sufficient to produce a metering pressure differential across the fuel in the secondary main metering system including fixed metering restriction 79 and passage 542. Consequently, the secondary main metering fuel system starts to operate in the same manner as described with reference to the primary main metering system and, further, is modulated by the modulating means 102 in the same manner as such means 102 modulates the overall rate of metered primary main fuel flow. As a result of such modulation during secondary operation, the curve 200 (of FIG. 5) continues beyond line 220 as depicted by the solid line (to the right of line 220) labeled 220*a* and, similarly, curve 204 continues beyond line 220 as depicted by the dash line (to the right of line 220) labeled 204*a* while curve 202 continues beyond line 220 as depicted by the dash line (to the right of line 220) labeled 202*a*. Without the modulation provided by the means 102 the curve portenis to the right of line 220, instead of being as generally depicted by curve portenis 200*a*, 202*a* and 204*a*, would be more like the respective dotted curve portenis 200*b*, 202*b* and 204*b* indicating an actual reduction in the fuel-air ratio.

The invention has been illustrated as employing a secondary fixed metering restriction 79 in parallel fluid circuit with passage means 542. It should, of course, be clear that such is the preferred embodiment and that the invention can be practiced without such a parallel fluid circuit comprised of restriction 79 and that the modulated passage means 542 may, in fact, be the sole circuit for supplying metered fuel to the secondary induction passage means.

Although only a preferred embodiment and selected modifications of the invention have been disclosed and described, it is apparent that other embodiments and modifications of the invention are possible within the scope of the appended claims.

What is claimed is:

1. A fuel metering system for a combustion engine having engine exhaust conduit means, comprising fuel carbureting means for supplying metered fuel flow to said engine, said carbureting means comprising first and second induction passage means for supplying motive fluid to said engine, a source of fuel, primary main fuel metering system means communicating generally between said source of fuel and said first induction passage means, idle fuel metering system means communicating generally between said source of fuel and said first induction passage means, secondary main fuel metering system means communicating generally between said source of fuel and said second induction passage means, controlled modulating valving means effective to controllably increase and decrease the rate of metered fuel flow through each of said primary and secondary main fuel metering system means and said idle fuel metering system means, oxygen sensor means effective for sensing the relative amount of oxygen present in engine exhaust gases flowing through said exhaust conduit means and producing in accordance therewith a first output, said modulating valving means comprising solenoid winding means for actuation of said modulating valving means, electrical logic control means effective for receiving said first output signal and in response thereto producing a second output and effectively applying said second output to said solenoid winding means to thereby cause said modulating valve means to alter said rate of metered fuel flow through each of said primary and secondary main fuel metering system means and said idle fuel metering system means as to provide for rates of metered fuel flow therethrough ranging from a preselected "lean" fuel-air mixture ratio supplied to said engine to a preselected "rich" fuel-air mixture ratio supplied to the engine, said modulating valving means being effective upon occurrence of an electrical failure in said electrical logic control or said solenoid winding means to thereafter permit only that rate of metered fuel flow through each of said primary and secondary main fuel metering system means and said idle fuel metering system means as will result in said preselected "lean" fuel-air mixture ratio being supplied to said engine, wherein said idle fuel metering system means comprises idle air bleed means, wherein said primary main fuel metering system means comprises first fuel flow orifice means, wherein said secondary main fuel metering system means comprises second fuel flow orifice means, wherein said idle air bleed means is spaced from both of said first and second fuel flow orifice means, said modulating valving means comprising housing means, said housing means comprising a first end portion, a second end portion, said first end portion being adapted for operative connection to said carbureting means, said second end portion being adapted for operative connection to said carbureting means, solenoid motor means, said solenoid motor means comprising axially extending spool means, said spool means comprising a generally centrally disposed tubular portion, said solenoid winding means being carried by said spool means, axially extending armature means situated in said tubular portion for reciprocating movement therein, motion transmitting means operatively connected to a first end of said armature means and generally axially aligned therewith, a first opening formed through said first end portion for permitting the free axial movement of said armature means therein, a second opening formed through said second end portion for permitting the free movement of said motion transmitting means therein, a first valve member operatively connected to a second end of said armature means opposite to said first end, said first valve member being effectively juxtaposed to both of said first and second fuel flow orifice means, a second valve member operatively connected to said motion transmitting means, said second valve member being effectively juxtaposed to said air bleed means, said first and second valve members moving in unison with said armature means so that when said first valve member moved toward both said first and second fuel flow orifice means said second valve member moves away from said air bleed means and when said first valve member moves away from both of said first and second fuel flow orifice means said second valve member moves toward said air bleed means, and resilient means effective for continually resiliently urging said armature means in a direction whereby said first valve member is moved toward both of said first and second fuel flow orifice means and said second valve member is moved away from said air bleed means.

2. A fuel metering system for a combustion engine, comprising fuel carbureting means for supplying metered fuel flow to said engine, said carbureting means comprising first and second induction passage means for supplying motive fluid to said engine, a source of fuel, primary main fuel metering system means communicating generally between said source of fuel and said first induction passage means, idle fuel metering system means communicating generally between said source of fuel and said first induction passage means, secondary main fuel metering system means communicating generally between said source of fuel and said second induction passage means, controlled modulating valving means effective to controllably increase and decrease the rate of metered fuel flow through each of said primary and secondary main fuel metering system means and said idle fuel metering system means, said modulating valving means being effective to alter said rate of metered fuel flow through each of said primary and secondary main fuel metering system means and said idle fuel metering system means as to provide for rates of metered fuel flow therethrough ranging from a preselected "lean" fuel-air mixture ratio supplied to said engine to a preselected "rich" fuel-air mixture ratio supplied to said engine, oxygen sensor means effective for sensing the relative amount of oxygen present in exhaust gases flowing from said engine and producing in accordance therewith a first output, wherein said first output comprises means for controlling said controlled modulating valving means, wherein said idle fuel metering system means comprises idle air bleed means, wherein said primary main fuel metering system means comprises first fuel flow orifice means, wherein said secondary main fuel metering system means comprises second fuel flow orifice means, wherein said idle air bleed means is spaced from both of said first and second fuel flow orifice means, said modulating valving means comprising housing means, said housing means comprising a first end portion and a second end portion, said first end portion being adopted for operative connection to said carbureting means, said second end portion being adapted for operative connection to said carbureting means, solenoid motor means, said solenoid motor means comprising axially extending spool means, said spool means comprising a generally centrally disposed tubular portion, said solenoid winding means being carried by said spool means, axially extending armature means situated in said tubular portion for reciprocating movement therein, motion transmitting means operatively connected to a first end of said armature means and generally axially aligned therewith, a first opening formed through said first end portion for permitting the free axial movement of said armature means therein, a second opening formed through said second end portion for permitting the free movement of said motion transmitting means therein, a first valve member operatively connected to a second end of said armature means opposite to said first end, said first valve member being effectively juxtaposed to both of said first and second fuel flow orifice means, a second valve member operatively connected to said motion transmitting means, said second valve member being effectively juxtaposed to said air bleed means, said first and second valve members moving in unison with said armature means so that when said first valve member moves toward both of said first and second fuel flow orifice means said second valve member moves away from said air bleed means and when said first valve member moves away from both of said first and second fuel flow orifice means said second valve member moves toward said air bleed means, and resilient means effective for continually resiliently urging said armature means in a direction whereby said first valve member is moved toward both of said first and second fuel flow orifice means and said second valve member is moved away from said air bleed means.

3. A fuel metering system according to claim 1 wherein said first opening in said first end portion comprises bearing surface means engageable with said armature means.

4. A fuel metering system according to claim 1 wherein said first valve member is operatively secured to said armature means as to be secured against any axial movement thereof relative to said armature means.

5. A fuel metering system according to claim 1 wherein said resilient means resiliently urges said armature means in said direction by applying a resilient force to said armature means through operative engagement with said motion transmitting means.

6. A fuel metering system according to claim 1 wherein said resilient means resiliently urges said armature means in said direction by applying a resilient force to said armature means through operative engagement with said second valve member.

7. A fuel metering system according to claim 2 wherein said first opening in said first end portions comprises bearing surface means engageable with said armature means.

8. A fuel metering system according to claim 2 wherein said first valve member is operatively secured to said armature means as to be secured against any axial movement thereof relative to said armature means.

9. A fuel metering system according to claim 2 wherein said resilient means resiliently urges said armature means in said direction by applying a resilient force to said armature means through operative engagement with said motion transmitting means.

10. A fuel metering system according to claim 2 wherein said resilient means resiliently urges said armature means in said direction by applying a resilient force to said armature means through operative engagement with said second valve member.

* * * * *